United States Patent [19]

Anderson

[11] 4,347,049

[45] Aug. 31, 1982

[54] BALANCE HYDRAULIC PUMPING UNIT

[76] Inventor: John M. Anderson, P.O. Box 5202, Corpus Christi, Tex. 78405

[21] Appl. No.: 160,347

[22] Filed: Jun. 17, 1980

[51] Int. Cl.[3] ..... F04B 47/12; F04B 47/14

[52] U.S. Cl. ..... 417/403; 60/372

[58] Field of Search ..... 60/371, 372; 417/403, 417/404, 401; 92/8, 134

[56] References Cited

U.S. PATENT DOCUMENTS

| | | | |
|---|---|---|---|
| 2,325,138 | 7/1943 | Kyle et al. | 60/372 X |
| 2,366,777 | 1/1945 | Farley et al. | 60/372 X |
| 2,429,947 | 10/1947 | Rose | 417/388 |
| 3,005,413 | 10/1961 | Coberly | 60/372 X |

FOREIGN PATENT DOCUMENTS

| | | | |
|---|---|---|---|
| 1070216 | 1/1980 | Canada | 60/372 |

*Primary Examiner*—Leonard E. Smith
*Attorney, Agent, or Firm*—Fulbright & Jaworski

[57] ABSTRACT

A balanced hydraulic well pumping unit for actuating an underground pump in which the weight of the downstroke is utilized to store energy in an accumulator which is then used to assist in the upward stroke of the pump. A working rod passes through first and second vertically positioned cylinders and is connected to first and second pistons in the cylinders, respectively. Hydraulic power means are connected to the first cylinder for alternately supplying hydraulic fluid to opposite sides of the first piston for moving the working rod upwardly and downwardly. An accumulator is connected to opposite ends of the second cylinder whereby downward movement of the working rod causes the second piston to store energy in the accumulator which is then used to assist movement of the working rod upwardly on the upward stroke of the pumping unit. Preferably, the sucker rod of the well pump extends into the working rod thereby allowing the pumping unit to be positioned close to the well surface. Various controls are provided for admitting and replenishing air and hydraulic fluid to the accumulator and second cylinder, but limiting the amount of air and hydraulic fluid.

3 Claims, 6 Drawing Figures

64
18
28
50
62
66
86
90
98
92
12
13
24
26
15
80
82

64
18
28
50
62
66
86
90
98
92
12
13
14
24
16
26
15
80
82

BALANCE HYDRAULIC PUMPING UNIT

BACKGROUND OF THE INVENTION

Generally, it is old to store the energy from the downstroke of an underground well pump and to utilize the stored energy to assist the well pump in its upward stroke. The present invention is directed to an improved hydraulic pumping unit for actuating an underground pump which utilizes a second piston and an accumulator for storing energy on the downstroke thereby providing a system which reduces the power required, requires less hydraulic operating pressure, allows the pumping unit to be mounted close to the wellhead, and which automatically makes up and limits the air and fluid requirements of the unit.

SUMMARY

The present invention is directed to a balanced hydraulic well pumping unit in which a working rod passes through first and second vertically positioned cylinders. First and second pistons are connected to the rod and positioned in the first and second cylinders, respectively. Hydraulic power is connected to the first cylinder on both sides of the first piston for alternately supplying hydraulic fluid to opposite sides of the first piston for moving the working rod upwardly and downwardly. An accumulator is provided with first and second fluid connections between the end thereof to the second cylinder at a position above and below the second piston. As the pumping unit moves downwardly, the second piston stores energy in the accumulator for assisting the movement of the pumping unit on its upward stroke.

Still a further object is the provision wherein the sucker rod of the underground well pump extends in and is connected to the working rod thereby allowing the pumping unit to be positioned adjacent the well surface.

A still further object of the present invention is the provision of a control circuit for allowing the admission of air and hydraulic fluid to the second cylinder and accumulator for building up the balancing pressures, admitting further fluids when needed, and limiting the pressures in the pumping unit.

Still a further object of the present invention is the provision of a first check valve allowing fluid flow from the air in the second cylinder to the accumulator to build up the pressure in the accumulator and a second check valve connected to the second cylinder above the second piston allowing flow of air from the atmosphere into the second cylinder.

Yet a further object of the invention is the provision of a relief valve connected to the one end of the accumulator for limiting the fluid pressure in the accumulator, and a relief valve connected to the second cylinder above the second piston for allowing air at a predetermined pressure to flow from the second cylinder.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
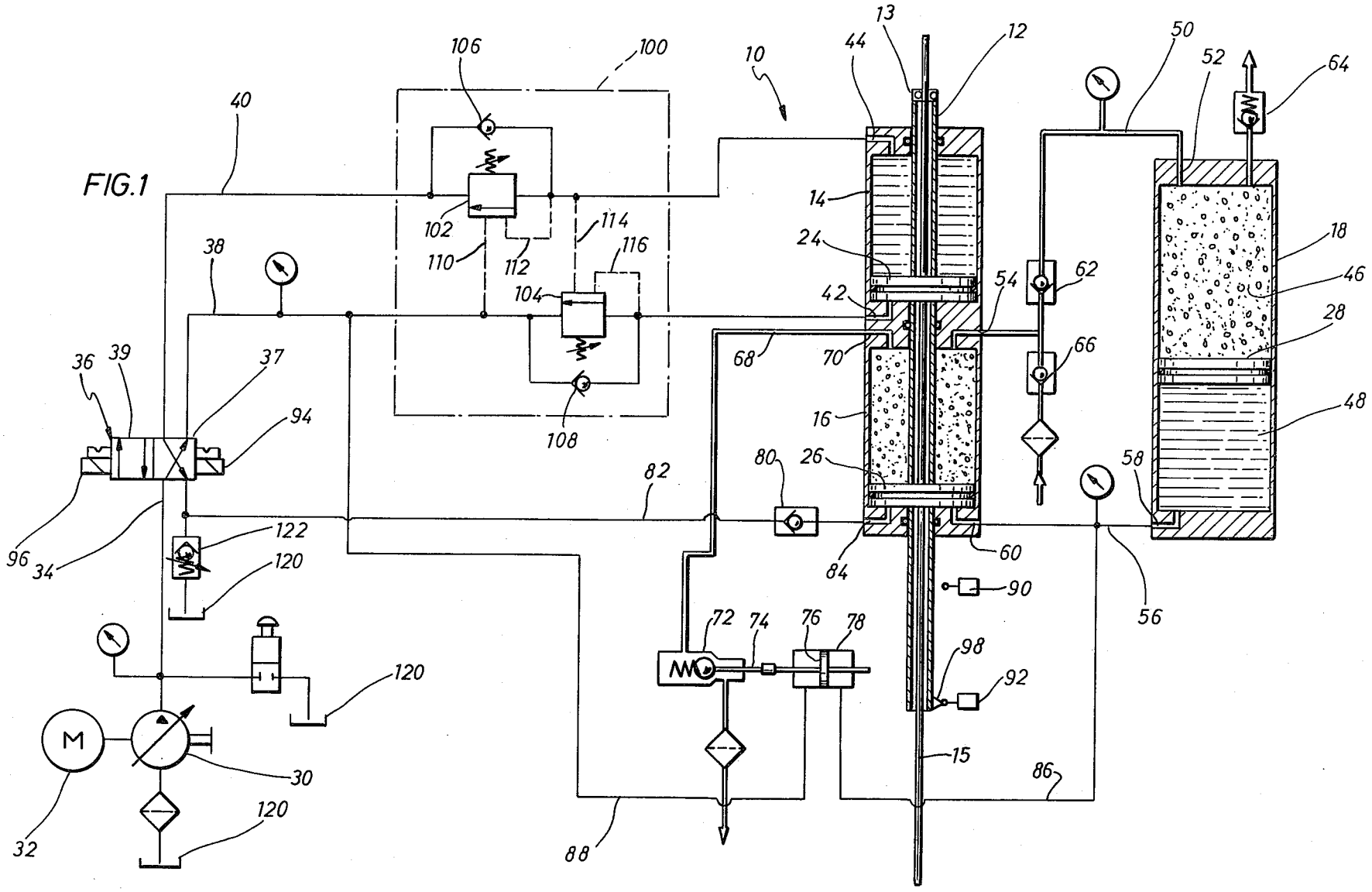
FIG. 1 is a schematic diagram of the balanced hydraulic pumping unit of the present invention and its controls.

Referring now to the drawings, particularly to FIG. 1, the reference numeral 10 generally indicates the balanced hydraulic pumping unit of the present invention and generally includes a working rod 12 passing through a first cylinder 14 and a second cylinder 16, and includes accumulator 18 and suitable controls.

The cylinders 14 and 16 are vertically positioned with the cylinder 14 being the pumping cylinder and the cylinder 16 being the balancing cylinder. A first piston 24 is connected to the working rod 12 and positioned in the first cylinder 14. A second piston 26 is also connected to the working rod 12 and is positioned in the second cylinder 16.

The sucker rod 15 of an underground well pump (not shown) is connected to the working rod 12 such as extending therethrough and connected to the working rod such as by clamp 13. Therefore, actuation of the working rod 12 will actuate the sucker rod 15 and the underground pump.

Suitable hydraulic means such as a hydraulic pump 30 which is actuated by an electric motor 32 provides hydraulic fluid through line 34 and to a pilot operated hydraulic control switch 36 for alternately supplying hydraulic fluid to lines 38 and 40 and to ports 42 and 44 connected to the first cylinder 14 on opposite sides of the piston 24 for moving the working rod 12 upwardly and downwardly in response to the hydraulic fluid.

The accumulator 18 includes a separation means such as piston 28 which separates a first fluid such as air 46 from a second fluid such as hydraulic fluid 48. A first fluid connection 50 is provided between one end of the accumulator 18 from a port 52 and a port 54 to the second cylinder at a point above the second piston 26. A second fluid connection 56 is provided between a port 58 at the second end of the accumulator 18 and a port 60 in the second cylinder 16 at a point below the second piston 26. Therefore, downward movement of the first piston 24 in the pumping cylinder 14, which occurs through actuation of hydraulic fluid from the motor 30 as well as gravity of the pull of the sucker rod 15 of the underground pump, causes the second piston 26 in the balancing cylinder 16 to move downwardly. Downward movement of piston 26 forces hydraulic fluid from beneath the piston 26 and into the bottom of the accumulator 48 to compress the air 46 above the piston 28 to store the energy of the downstroke of the pump. Thereafter, upward movement of the piston 24 in the pumping cylinder 14 which is caused by pumping fluid from the hydraulic pump 30 through the line 38 to move the pump in its upstroke, is assisted by the hydraulic pressure from the hydraulic fluid 48 in the accumulator 18 acting on the bottom of piston 26.

Various controls may be provided if desired for admitting, replenishing, and limiting the pressures during the operation of the pumping unit 10. A first check valve 62 is provided in the fluid connection 50 for allowing air flow from the second cylinder 16 to the accumulator 18 for supplying and replenishing the air supply in the accumulator 18 when needed. A relief valve 64 is connected to the accumulator 18 in communication with the air 46 for relieving the air pressure in the event that it becomes excessive. A second check valve 66 is connected between the atmosphere and the second cylinder 16 above the second piston 26 for allowing flow of air from the atmosphere into the second cylinder 16. A line 68 is provided in communication with a port 70 leading to the second cylinder 16 and leading to a spring-loaded plunger operated check valve 72 such as Model No. MOC203 sold by Deltrol. The plunger 74 is connected to a double acting piston 76 in a cylinder 78 for exhausting air from the cylinder 16. One side of the piston 76 is connected to line 86 to the hydraulic pressure of the hydraulic fluid 48 in the accumulator 18. The second side of the piston 76 is connected to line 88 which in turn is connected to hydraulic fluid line 38.

A hydraulic check valve 80 is connected to a hydraulic supply line 82 for admitting hydraulic fluid to port 84 which is in communication with the second cylinder 16 below the piston 26 for supplying hydraulic fluid, when needed, to the cylinder 16 and the accumulator 18 through line 56.

Limit switches 90 and 92 are provided which are in turn connected to pilot solenoids 94 and 96, respectively, for actuating the hydraulic control valve 36 and are in turn controlled by a cam 98 which may be connected to the rod 12 for reversing the stroke of the pumping unit 10.

Another set of fluid controls is a counterbalanced valve generally indicated by the referenced numeral 100 such as Model No. 1EE13P330S sold by Fluid Controls. The valve 100 includes two spring actuated on and off valves 102 and 104 each of which includes a check valve 106 and 108, respectively. Valve 102 also includes control lines 110 and 112 while valve 104 includes control lines 114 and 116.

Figure 3:
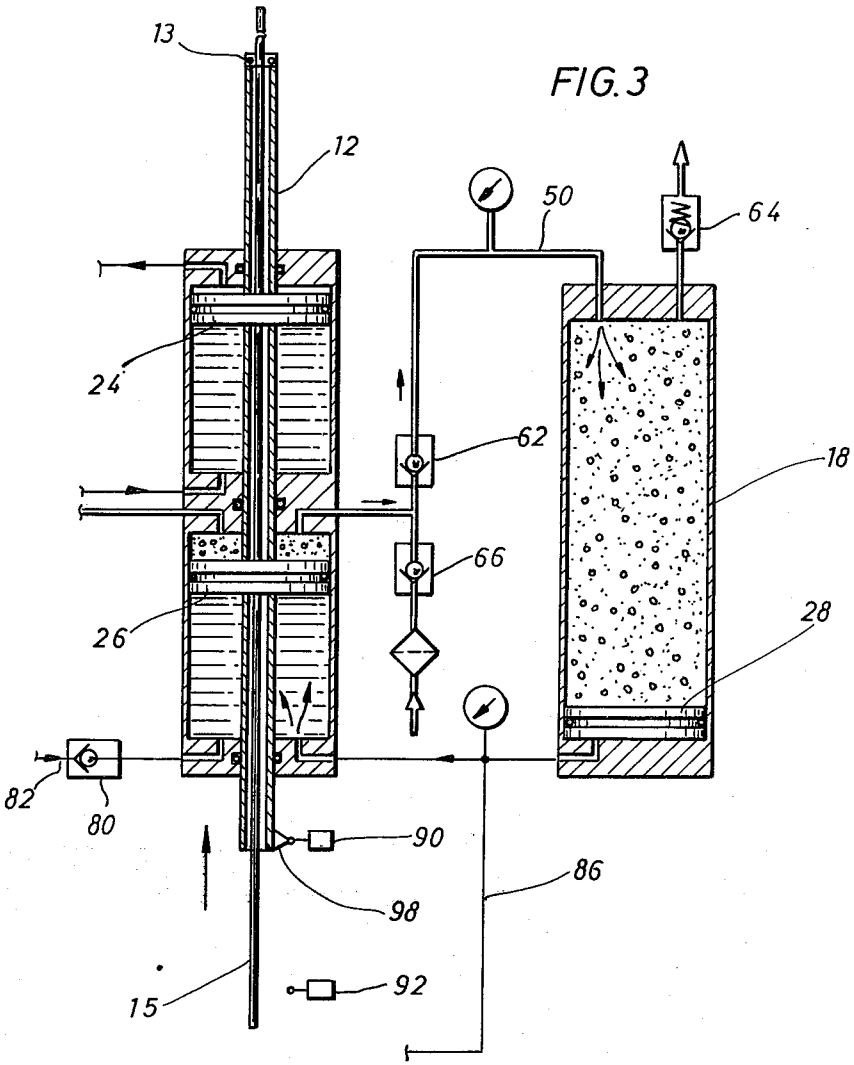
FIGS. 2–5 are schematic elevational views illustrating the principle of starting, charging, and operating the hydraulic pumping unit of the present invention.
Figure 2:
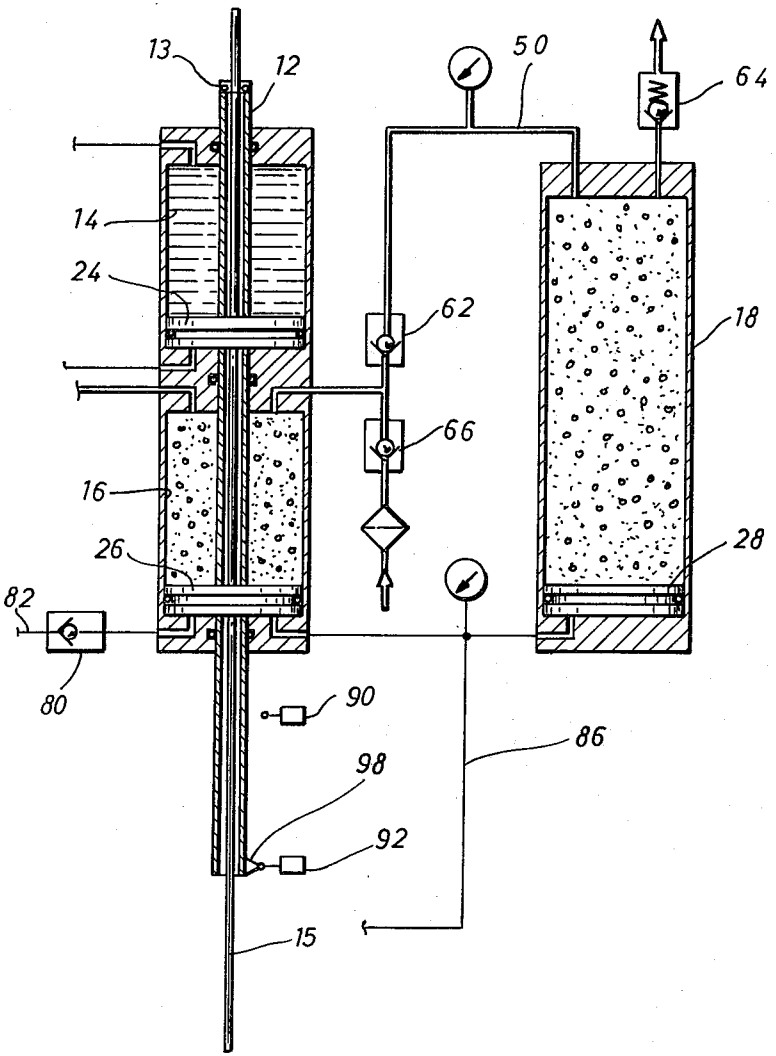

The present invention will operate from startup to introduce the proper operating fluids to their operating positions and in the correct volumes and pressure, will replenish the fluids as needed, and will limit the fluids to the proper pressures. At startup, the pistons 24, 26 and 28 will be in the positions shown in FIG. 2 with the cylinder 14 filled with hydraulic fluid while the cylinder 16 and the accumulator 18 will be filled with air. The cam 98 actuates limit switch 92 which in turn actuates solenoid 94 to move hydraulic control valve 36 in the position shown in FIG. 1 with block 37 in communication with the hydraulic supply line 34 from the hydraulic pump 30 which draws hydraulic fluid from the sump 120. Hydraulic fluid flows through block 37 into line 38 whereby valve 102 is actuated from pressure control line 110 to move to the open position allowing venting from the first cylinder 14 through the line 40, and fluid passes through check valve 108 to move valve 104 to the open position by the action of control line 116. Hydraulic fluid flows in through port 42 raising piston 24 and expelling hydraulic fluid above the piston 24 through port 44 to line 40 and valve block 37 to line 82. Referring now to FIGS. 2 and 3, upward movement of the piston 24 carries working rod 12 and sucker rod 15 upwardly as well as piston 26 upwardly. Piston 26 draws in hydraulic fluid from line 82 through check valve 80 into port 84 into the balancing cylinder 16 beneath the piston 26 since fluid line 38 is pressured. Hydraulic pressure is applied to control piston 76 through line 88 as line 86 to the opposite side of control piston 76 is at a low pressure whereby air valve 72 is kept in the closed position. Upward movement of piston 26 also pumps atmospheric air from cylinder 16 through port 54, check valve 62 and port 52 into the accumulator 18 above the piston 28.

Figure 5:
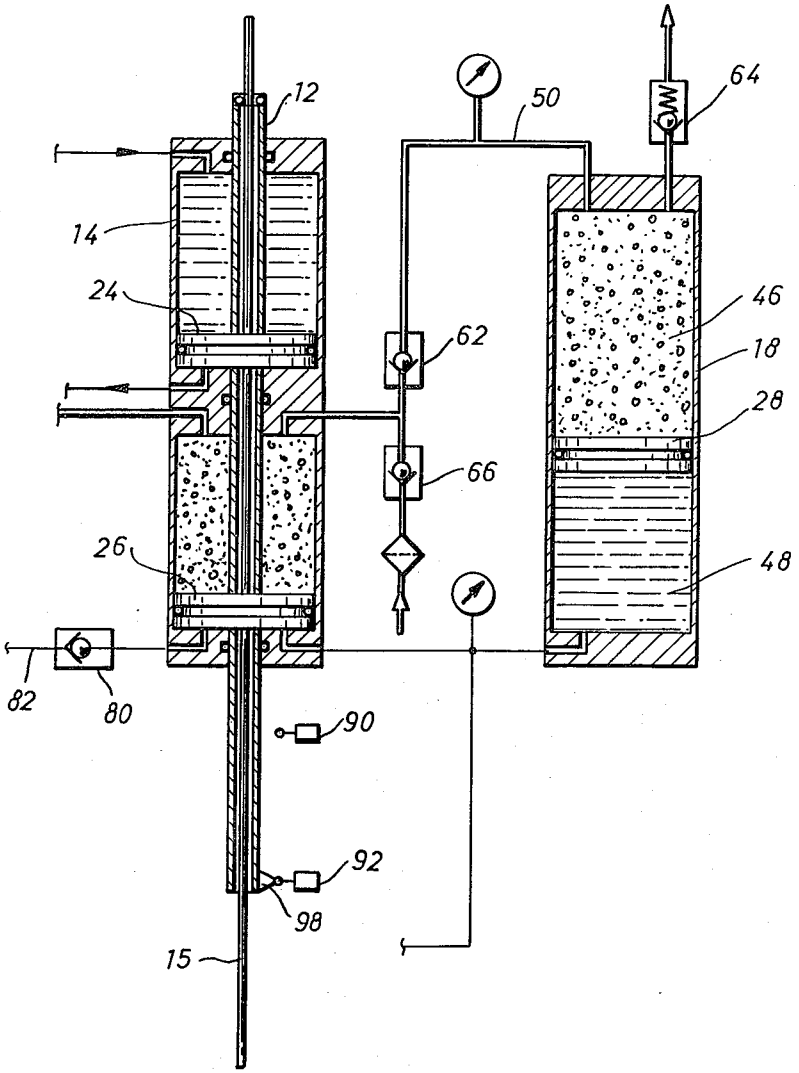
Figure 4:
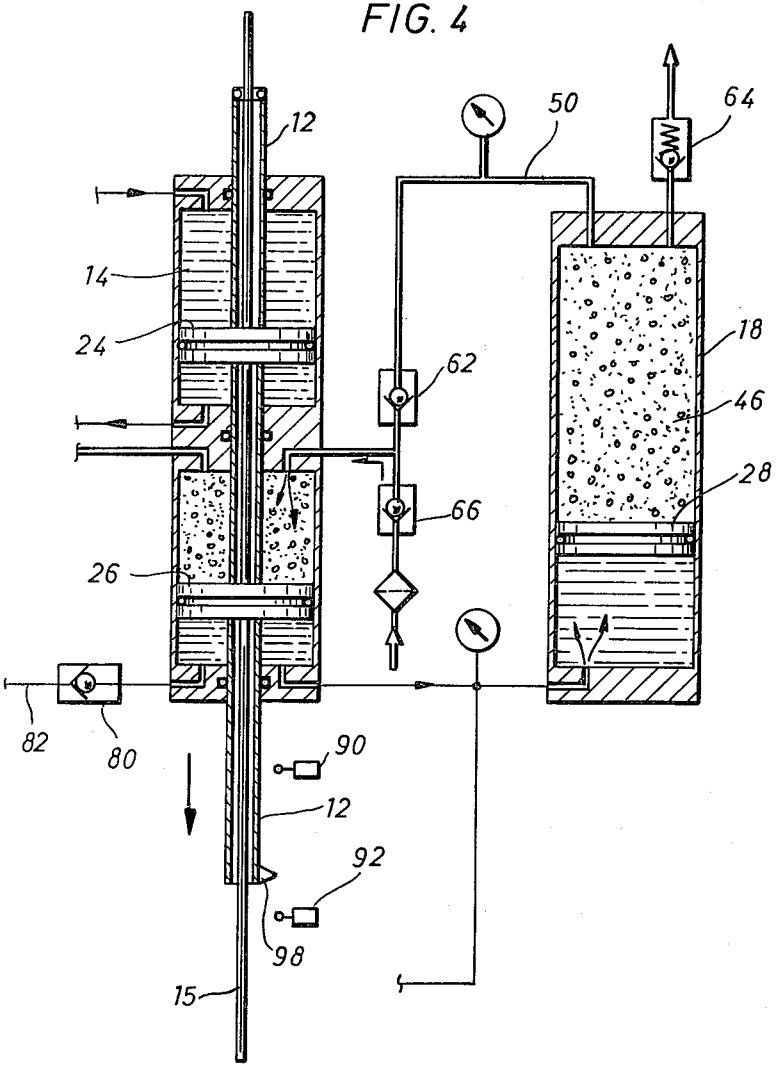

At the end of the first stroke after startup, as best seen in FIG. 3, as the cam 98 engages and actuates limit switch 90 the hydraulic control switch 36 is actuated by solenoid 96 to place valve block 39 in position between lines 38 and 40 and in communication with lines 34 and 82. The weight of the sucker rod 15 will cause a downward stroke and the hydraulic fluid to the pumping cylinder 14 will be reversed, as best seen in FIG. 4. Thus, hydraulic fluid will flow from the pump 30 to line 40, through check valve 106 to actuate valves 102 and 104 through pressure control lines 112 and 114, respectively, and into the top of the cylinder 14. Hydraulic fluid is vented from cylinder 14 through line 38 to line 82 but in this case will flow through bias check valve 122 to the sump 120 as check valve 80 will be closed. That is, as the pumping unit moves from FIG. 3 to FIG. 4 hydraulic fluid in the balancing cylinder 16 beneath the piston 26 will be checked against flow by the check valve 80 but will flow through port 60 through line 56 into port 58 into the accumulator 18 beneath piston 28. Additional air is drawn into balancing cylinder 16 from the atmosphere through the check valve 66 through port 54. Additional air may be drawn through check valve 72 since the piston 76 is exposed to a greater pressure from line 86 then from line 88 and moves the valve 72 to the open position. As the pumping unit moves from the position shown in FIG. 4 to FIG. 5 it is noted that the hydraulic fluid is moved by the weight of the sucker rods into the accumulator 18 compressing the air 46 above the piston 28 thereby storing the energy in the accumulator 18 for assisting in raising the piston 26 and thus the sucker rod 15 on the next upstroke.

As the system completes the downstroke, as best seen in FIG. 5, the cam 98 will again actuate limit switch 92 to move the control valve 36 to the position seen in FIG. 1. Thereafter, hydraulic fluid will flow through line 38 to raise the piston 24 and the hydraulic fluid 48 in the accumulator will act to raise piston 26 thereby decreases the amount of power required from the hydraulic pump 30. Normally, in operation the pressure of the hydraulic fluid 48 will act through the line 86 against the piston 76 to open the valve 72 allowing the air in the balancing cylinder 16 above the piston 26 to vent through the line 68. However, if for any reason the pressure of the air 46 in the accumulator 18 decreases below a certain value then the pressure in the hydraulic fluid 48 acting against piston 76 would not overcome the then higher pressure in line 88 and the vent valve 72 would be closed causing the air above the piston 26 in the cylinder 16 to again move through the check valve 62, line 50, port 52 and repressurize the air 46 in the accumulator 18. Similarly, if additional hydraulic fluid is needed in the accumulator 48, it can be drawn in through line 82 and check valve 80 into the system.

Figure 6:
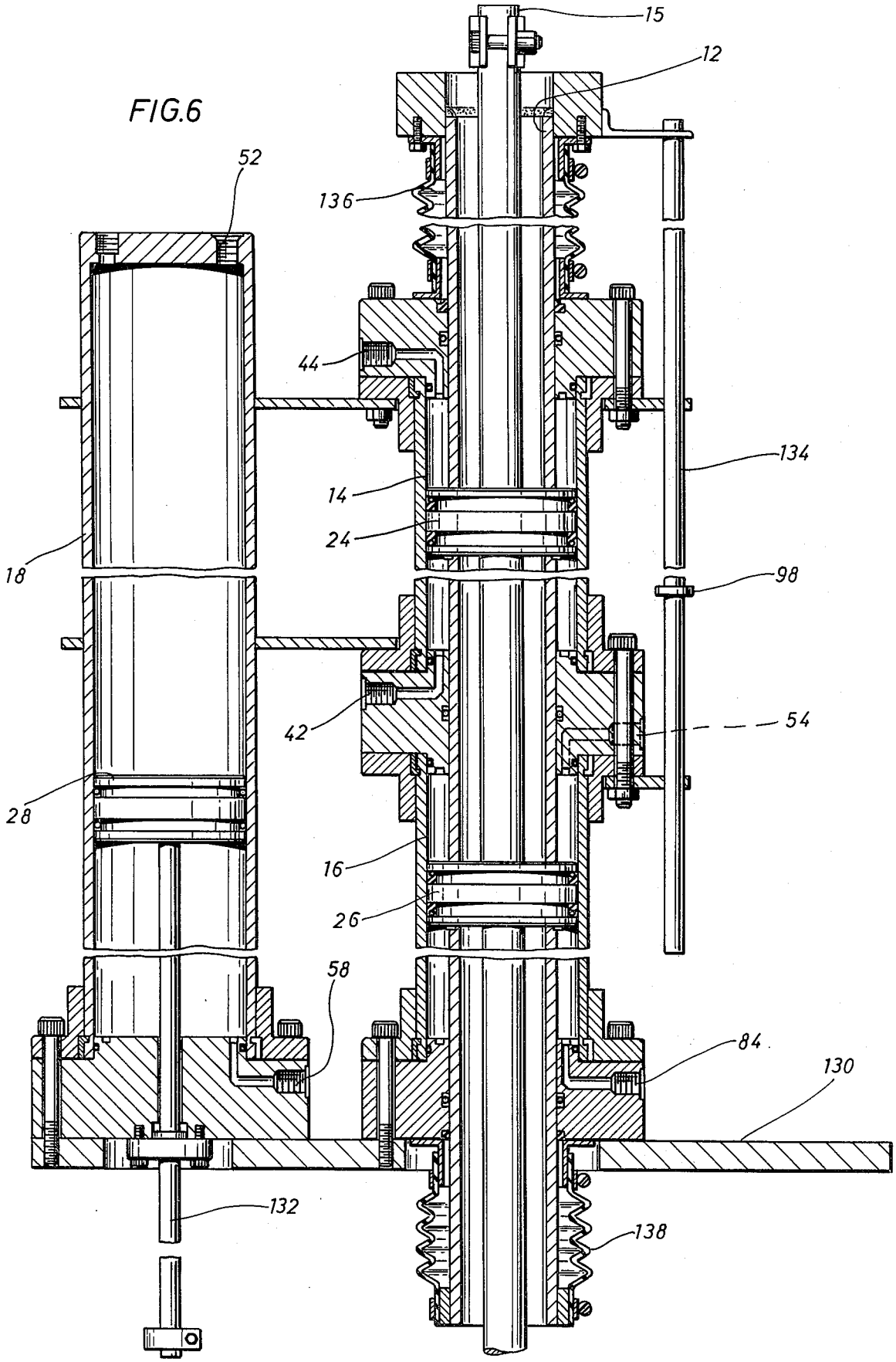
FIG. 6 is an elevational view, in cross section, of the pumping unit of the present invention.

Referring now to FIG. 6, a cross section view showing the mechanical configuration of the vertical cylinders 14 and 16 in the accumulator 18 is thus seen. The structure is supported from a base 130 which may be secured adjacent the well head of the well for providing a low pumping unit structure which is easily accessible for repair and maintenance. An extension rod 132 may be connected to the piston 28 of the accumulator 18 to provide a visual indication from the exterior of the accumulator 18 to indicate the position of the piston 28. The cam 98 for actuating the limit switches may be connected to a rod 134 which in turn is secured to the working rod 12. Flexible protective covers 136 and 138 are connected at opposite ends around the working rod 12 for preventing dirt and debris from adversely affecting the seals through which the rod 12 moves.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A balance hydraulic well pumping unit comprising, a working rod passing through first and second vertically positioned cylinders, a first piston positioned in the first cylinder and connected to the rod, a second piston positioned in the second cylinder and connected to the rod, hydraulic power means connected to the first cylinder on both sides of the first piston for alternately supplying hydraulic fluid to opposite sides of the first piston for moving the working rod upwardly and downwardly;

an accumulator, a first fluid connection between one end of the accumulator and the second cylinder at a point above the second piston, a second fluid connection between the second end of the accumulator and the second cylinder at a point below the second piston whereby movement of the first piston downwardly actuates the second piston to store energy in the accumulator for assisting the movement of the working rod upwardly on the upward stroke of the pumping unit, said fluid in the second cylinder above the second piston is air and the first fluid connection includes, a first check valve allowing fluid flow from the second cylinder to the accumulator, a second check valve connected to the second cylinder above the second piston allowing flow of air from the atmosphere into the second cylinder, a relief valve connected to the one end of the accumulator, and a relief valve connected to the second cylinder above the second piston allowing air at a predetermined pressure to flow from the second cylinder.

2. The apparatus of claim 1 including a hydraulic supply line including a check valve for allowing the flow of hydraulic fluid into the second cylinder below the second piston.

3. The apparatus of claim 1 wherein the working rod is hollow and a sucker rod of a well pump extends through the hollow working rod and is adjustably connected thereto by a clamp.

* * * * *